US010670316B2

(12) United States Patent
Cao et al.

(10) Patent No.: US 10,670,316 B2
(45) Date of Patent: Jun. 2, 2020

(54) COMPRESSOR AND FAN STAGING IN HEATING, VENTILATION, AND AIR CONDITIONING SYSTEMS

(71) Applicant: Johnson Controls Technology Company, Auburn Hills, MI (US)

(72) Inventors: Kevin M. Cao, Oklahoma City, OK (US); Randal H. Edmunds, Norman, OK (US); Steven M. Maddox, Edmond, OK (US); David B. Woodward, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 108 days.

(21) Appl. No.: 15/944,615

(22) Filed: Apr. 3, 2018

(65) Prior Publication Data

US 2018/0372386 A1 Dec. 27, 2018

Related U.S. Application Data

(60) Provisional application No. 62/523,135, filed on Jun. 21, 2017.

(51) Int. Cl.

| | |
|---|---|
| ***F25B 7/00*** | (2006.01) |
| ***F25B 49/02*** | (2006.01) |
| ***F24F 11/30*** | (2018.01) |
| ***F24F 11/70*** | (2018.01) |

(Continued)

(52) U.S. Cl.

CPC ..... *F25B 49/022* (2013.01); *F24F 11/30* (2018.01); *F24F 11/70* (2018.01); *F24F 11/74* (2018.01);

(Continued)

(58) Field of Classification Search

CPC .. F24F 11/30; F24F 11/70; F24F 11/74; F24F 11/86; F24F 11/88; F24F 2110/10;

(Continued)

(56) References Cited

U.S. PATENT DOCUMENTS

| | | | |
|---|---|---|---|
| 4,389,853 | A | 6/1983 | Hile |
| 5,440,891 | A | 8/1995 | Hindmon, Jr. et al. |

(Continued)

FOREIGN PATENT DOCUMENTS

| | | |
|---|---|---|
| GB | 2207995 | 2/1989 |

*Primary Examiner* — Filip Zec

(74) *Attorney, Agent, or Firm* — Fletcher Yoder, P.C.

(57) ABSTRACT

The present disclosure relates to a heating, ventilating, and air conditioning (HVAC) unit including a first refrigeration circuit having a first compressor and a first condenser, a second refrigeration circuit having a second compressor and a second condenser, a first fan configured to generate airflow over the first condenser, a second fan configured to generate airflow over the second condenser, an evaporator common to the first refrigeration circuit and the second refrigeration circuit, and a controller configured to control operation of the HVAC unit according to an active staging operation of a plurality of staging operations, wherein the plurality of staging operations comprises at least three stages of operation in which each of the first and second compressors individually operates in a selection of at least two compression settings and each of the first and second fans individually operates in a selection of at least two speed settings.

29 Claims, 7 Drawing Sheets

(51) Int. Cl.

| | |
|---|---|
| ***F24F 11/88*** | (2018.01) |
| ***F25B 6/00*** | (2006.01) |
| ***F24F 11/74*** | (2018.01) |
| ***F24F 11/86*** | (2018.01) |
| *F24F 110/10* | (2018.01) |
| *F24F 110/20* | (2018.01) |

(52) U.S. Cl.
CPC ..... *F24F 11/86* (2018.01); *F24F 11/88* (2018.01); *F25B 6/00* (2013.01); *F25B 7/00* (2013.01); *F25B 49/025* (2013.01); *F24F 2110/10* (2018.01); *F24F 2110/20* (2018.01); *F25B 2600/0253* (2013.01); *F25B 2600/111* (2013.01); *F25B 2700/2104* (2013.01)

(58) Field of Classification Search
CPC ..... F24F 2110/20; F25B 2600/0253; F25B 2600/111; F25B 2700/2104; F25B 49/022; F25B 49/025; F25B 6/00; F25B 7/00
See application file for complete search history.

(56) References Cited

U.S. PATENT DOCUMENTS

| | | | | |
|---|---|---|---|---|
| 6,172,476 | B1 | 1/2001 | Tolbert, Jr. et al. | |
| 7,716,943 | B2 | 5/2010 | Seefeldt | |
| 7,762,091 | B2 | 7/2010 | Jin et al. | |
| 7,802,441 | B2 | 9/2010 | Seefeldt | |
| 8,287,230 | B2 | 10/2012 | Hurst, Jr. et al. | |
| 8,567,203 | B2 | 10/2013 | Jang et al. | |
| 8,683,817 | B2 | 4/2014 | Fraser | |
| 8,948,918 | B2 | 2/2015 | Chamorro et al. | |
| 9,562,710 | B2 * | 2/2017 | Pham | F25B 49/022 |
| 9,625,169 | B2 * | 4/2017 | Sakai | F24F 11/30 |
| 9,835,360 | B2 | 12/2017 | Wang et al. | |
| 2007/0022770 | A1 * | 2/2007 | Liu | F25B 49/022 62/228.1 |
| 2010/0146995 | A1 | 6/2010 | Mathews | |
| 2011/0197601 | A1 | 8/2011 | Booth et al. | |
| 2011/0302936 | A1 | 12/2011 | Wang et al. | |

* cited by examiner

COMPRESSOR AND FAN STAGING IN HEATING, VENTILATION, AND AIR CONDITIONING SYSTEMS

CROSS REFERENCE TO RELATED APPLICATIONS

This application claims priority from and the benefit of U.S. Provisional Application Ser. No. 62/523,135, entitled "THREE STAGE COMPRESSOR/OUTDOOR FAN STAGING WITH INTER-LACED EVAPORATOR," filed Jun. 21, 2017, which is hereby incorporated by reference.

BACKGROUND

The present disclosure relates generally to heating, ventilating, and air conditioning systems. A wide range of applications exist for heating, ventilating, and air conditioning (HVAC) systems. For example, residential, light commercial, commercial, and industrial systems are used to control temperatures and air quality in residences and buildings. Such systems often are dedicated to either heating or cooling, although systems are common that perform both of these functions. Very generally, these systems operate by implementing a thermal cycle in which fluids are heated and cooled to provide the desired temperature in a controlled space, typically the inside of a residence or building. Similar systems are used for vehicle heating and cooling, and as well as for general refrigeration. In some circumstances, initiation, termination, and certain characteristics of the thermal cycles may result in consuming an undesirable amount of electrical power and/or use of components of the HVAC system.

SUMMARY

The present disclosure relates to a heating, ventilating, and air conditioning (HVAC) unit including a first refrigeration circuit having a first compressor and a first condenser, a second refrigeration circuit having a second compressor and a second condenser, a first fan configured to generate airflow over the first condenser, a second fan configured to generate airflow over the second condenser, an evaporator common to the first refrigeration circuit and the second refrigeration circuit, and a controller configured to control operation of the HVAC unit according to an active staging operation of a plurality of staging operations, wherein the plurality of staging operations includes at least three stages of operation in which each of the first and second compressors individually operates in a selection of at least two compression settings and each of the first and second fans individually operates in a selection of at least two speed settings.

The present disclosure also relates to a heating, ventilation, and air conditioning (HVAC) system including a plurality of compressors, wherein each compressor of the plurality of compressors includes multiple compression settings, a plurality of fans, wherein each fan of the plurality of fans includes multiple speed settings, an interlaced evaporator, wherein each compressor of the plurality of compressors is configured to circulate refrigerant through the interlaced evaporator, and a controller configured to control operation of each fan of the plurality of fans and each compressor of the plurality of compressors according to an active staging operation of a plurality of staging operations, wherein each staging operation of the plurality of staging operations includes instructions to operate each compressor of the plurality of compressors individually in a selection of at least two compression settings and each fan of the plurality of fans individually in a selection of at least two speed settings.

The present disclosure further relates to a heating, ventilation, and air conditioning (HVAC) unit including a first refrigeration loop having a first compressor, a second refrigeration loop having a second compressor, a first outdoor fan and a second outdoor fan associated with the first refrigeration loop, a third outdoor fan and a fourth outdoor fan associated with the second refrigeration loop, an interlaced evaporator common to the first refrigeration loop and the second refrigeration loop, and a controller configured to control operation of the first outdoor fan, the second outdoor fan, the third outdoor fan, the fourth outdoor fan, the first compressor, and the second compressor according to each staging operation of a plurality of staging operations, wherein the first outdoor fan, the second outdoor fan, the third outdoor fan, and the fourth outdoor fan each have multiple speed settings, and the first compressor and the second compressor each have multiple compression settings.

DRAWINGS

DETAILED DESCRIPTION

The present disclosure is directed to heating, ventilating, and air conditioning (HVAC) systems and units, such as rooftop HVAC units, that employ various compressor and fan staging operations or sequences to provide conditioned air to a conditioned space. In general, the staging operations or sequences discussed below may be used with HVAC units that include at least two compressors that each have more than one setting for providing refrigerant, as well as two fans that can each operate at more than one speed. Based on input received from sensors and/or user input, a control system of the HVAC unit may send commands for the compressors and fans to operate in a manner that provides conditioned air of a desirable temperature while using less electrical power that similar units that do not employ the compressor and fan staging operations discussed herein.

Figure 1:
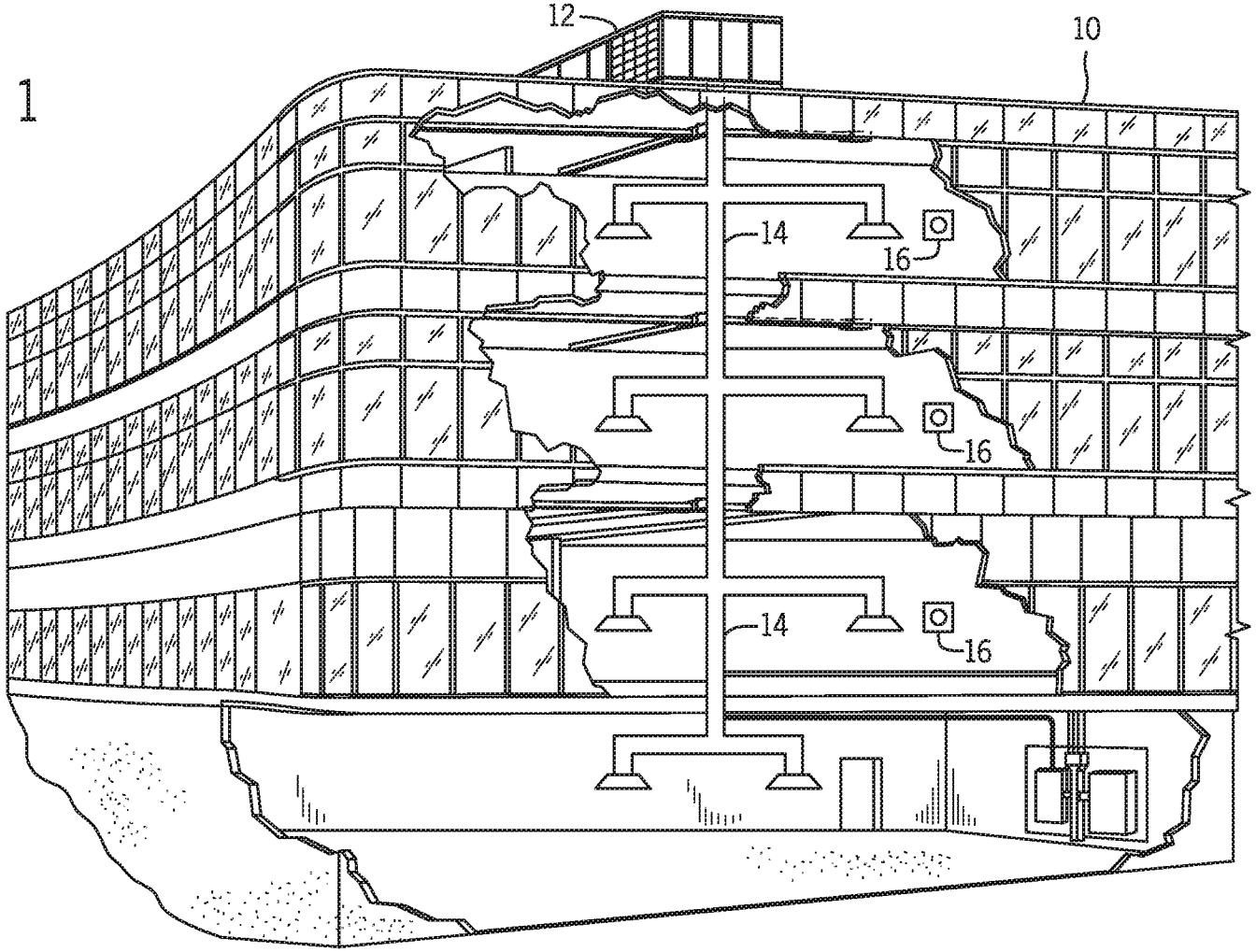
FIG. 1 is a perspective view of a heating, ventilating, and air conditioning (HVAC) system for building environmental management, in accordance with embodiments described herein.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
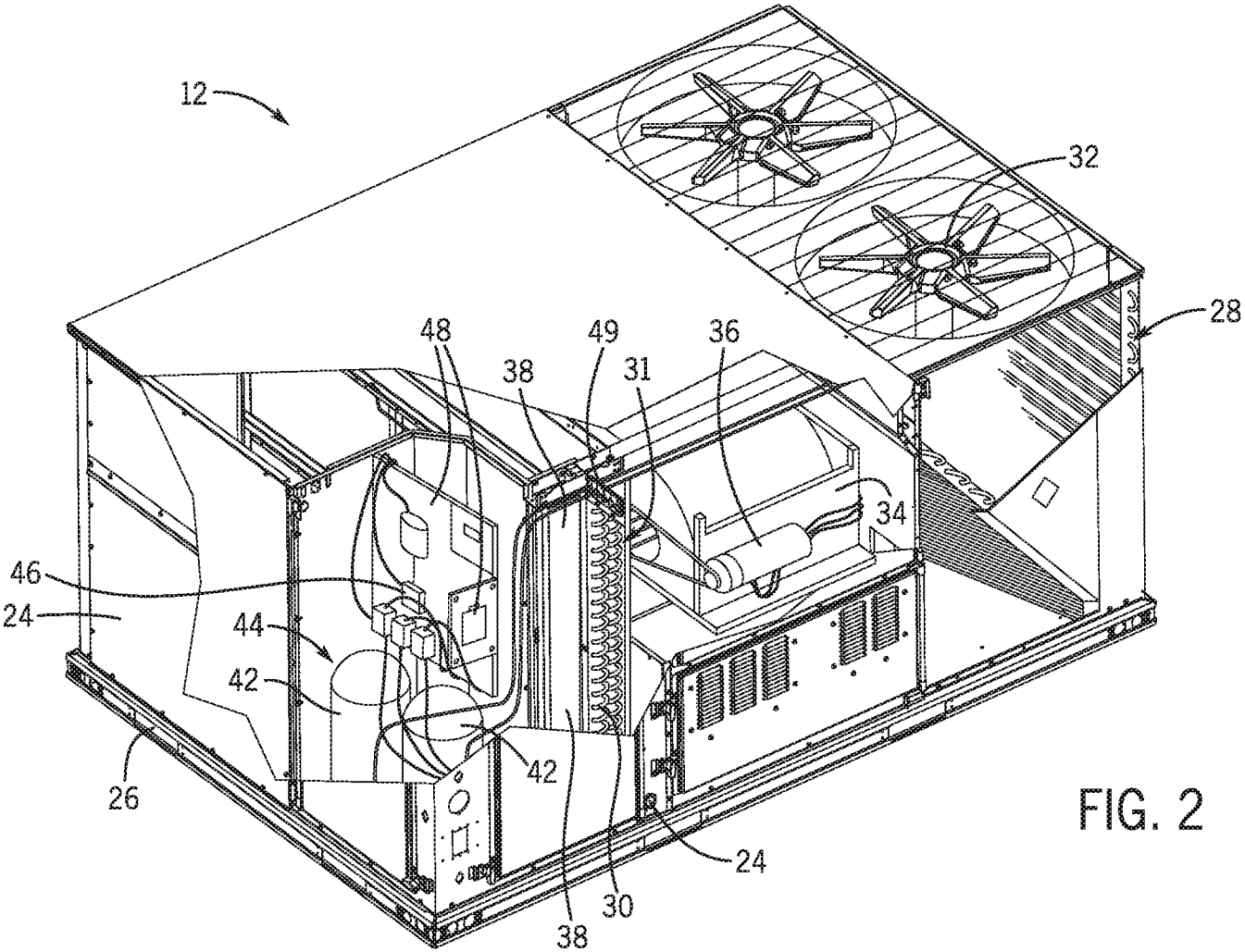
FIG. 2 is a perspective view of the HVAC unit of FIG. 1, in accordance with embodiments described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 align with the "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. For example, the speed of the motor 36 may be varied to change the quantity of air supplied by the blower assembly 34 based on signals from the control board 48. Wiring 49 may connect the control board 48 and the terminal block 46 to the equipment of the HVAC unit 12.

Figure 3:
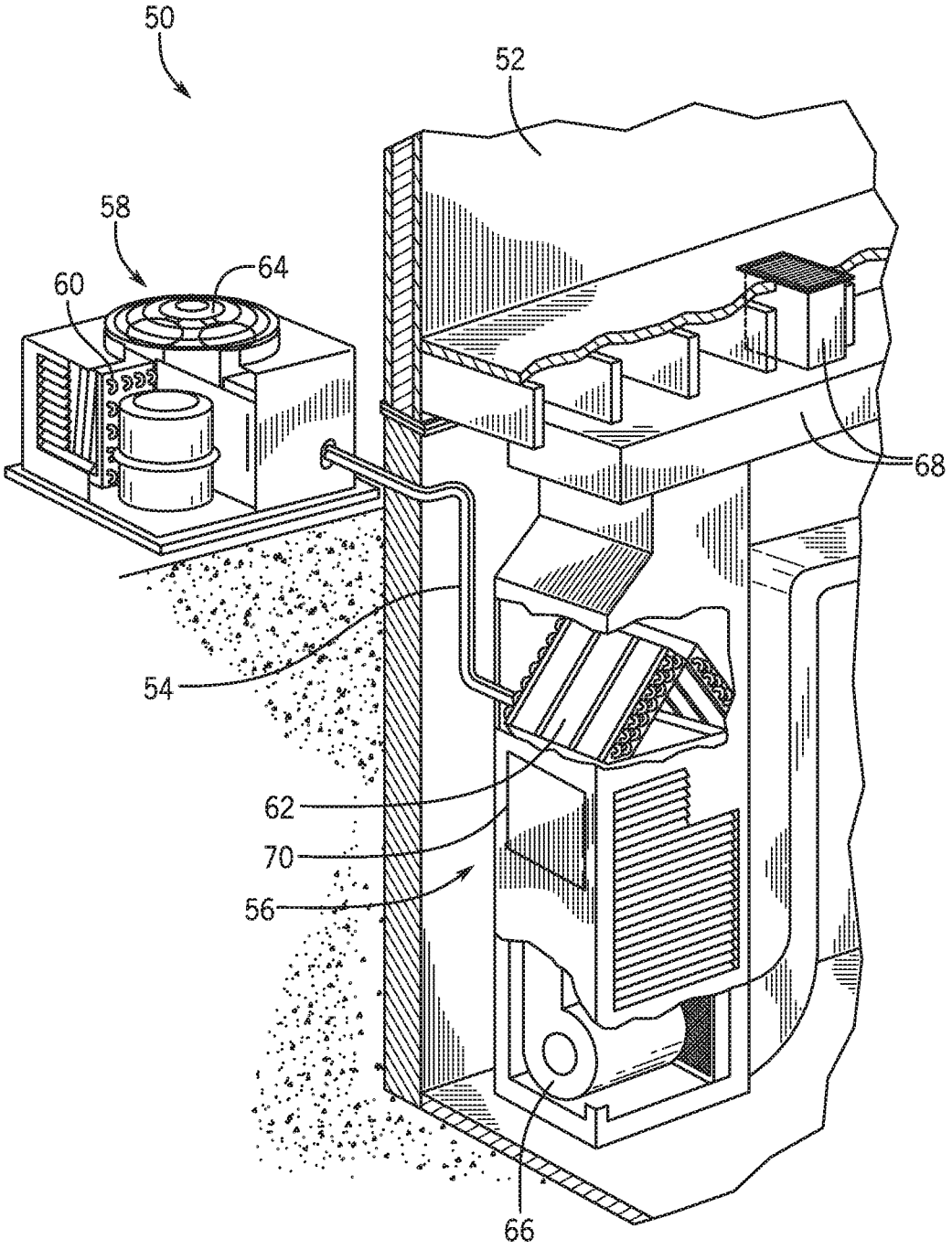
FIG. 3 is a perspective view of a residential heating and cooling system, in accordance with embodiments described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. In some instances the air may be expelled horizontally rather than above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
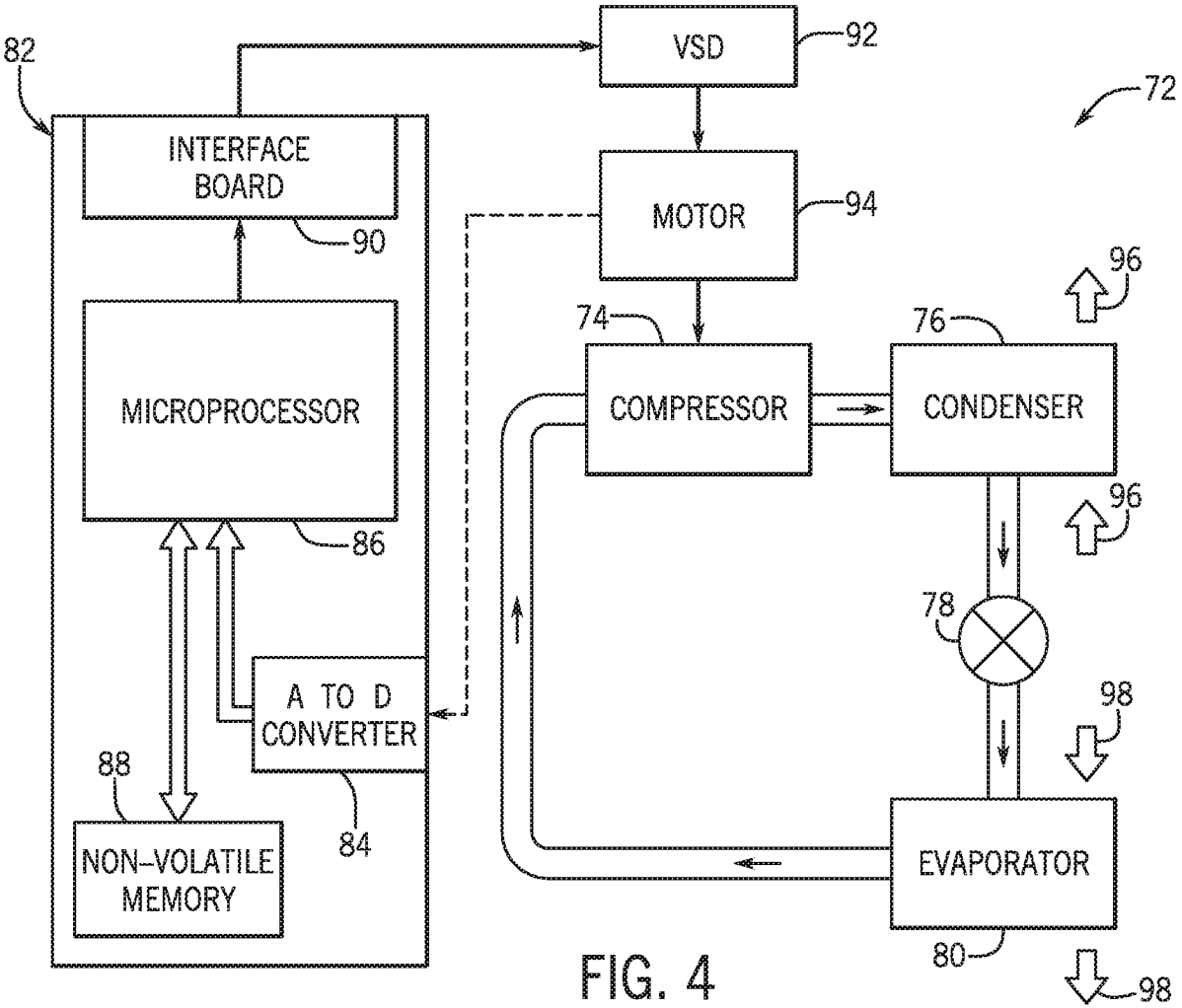
FIG. 4 is a schematic diagram of a vapor compression system that may be used in the HVAC system of FIG. 1 and the residential heating and cooling system FIG. 3, in accordance with embodiments described herein.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. Typically, though not necessarily, the motor 94 and compressor 74 are included in an integrated assembly. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor. In other embodiments, the compressor 74 may vary compression by other mechanical mechanisms or electrical changes without using a VSD 92. In any case, varying compression may change refrigerant flow through the vapor compression system.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, HVAC systems provide conditioned air to a particular space, such as the building 10. As additionally discussed above, HVAC units include fans that enable the HVAC units to intake environmental air, as well as vapor compression systems that are used to regulate the temperature of conditioned air supplied to conditioned spaces. As discussed below, compressor and fan staging operations may be employed to provide conditioned air of a desirable temperature while using less electrical power than similar units that do not employ the compressor and fan staging operations described herein. More specifically, the staging operations discussed herein are generally applicable to HVAC units that include at least two compressors that each have more than one setting for providing refrigerant, as well as two fans that can each operate at more than one speed.

Figure 5:
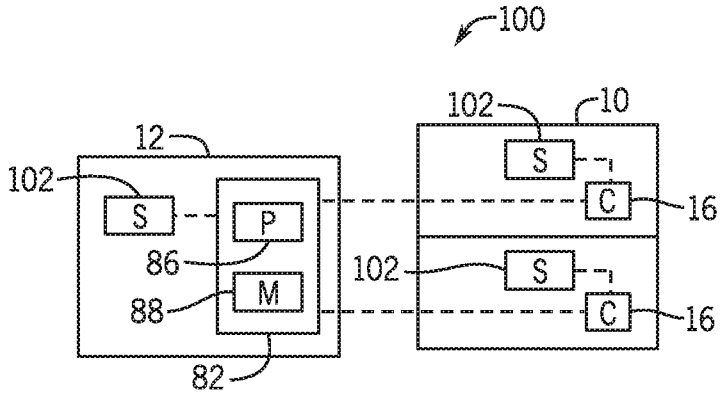
FIG. 5 is a schematic diagram of the HVAC system of FIG. 1, in accordance with embodiments described herein.

With the foregoing in mind, FIG. 5 is a schematic diagram of an HVAC system 100 that may be used to provide conditioned air to a conditioned space, such as the building 10. As described above in relation to FIG. 1, the HVAC unit 12 provides conditioned air to the building 10 via ductwork, such as ductwork 14 of FIG. 1. Additionally, operation of the HVAC unit 12 may be controlled via the control devices 16. That is, the temperature of the conditioned air, as well as other characteristics of the conditioned air, can be controlled via the control devices 16. As also mentioned above, the HVAC unit 12 may include the control panel 82, which can control operation of the HVAC unit 12 as well. Moreover, the control panel 82 and control devices 16 may coordinate to control operation of the HVAC unit 12. For instance, as illustrated, the control devices 16 are communicatively coupled to the control panel 82. For example, the control devices 16 may be coupled to the control panel 82 via a wired connection or a wireless connection, such as a wireless network. Via the processor 86, the control panel 82 may receive signals from the control devices 16 regarding settings for conditioned air to be supplied to the building 10. For instance, users may input temperature settings, such as a desired temperature of air supplied to the building and/or minimum and maximum temperatures of the air to be supplied by the HVAC unit 12, via the control devices 16.

As additionally illustrated, the HVAC system 100 includes sensors 102 that are communicatively coupled directly to the control panel 82 or indirectly to the control panel 82 via one of the control devices 16. For example, the sensors 102 disposed within the building 10 can be communicatively coupled to one or more of the control devices 16, which, in turn, are communicatively coupled to the control panel 82. The sensors 102 may sense the temperature of air within the HVAC system 100, as well as other characteristics of the air, such as pressure or humidity. For instance, the sensors 102 may detect air temperatures or other characteristics of the air within the building 10, air in the ductwork such as supply or return air, and air within the HVAC unit 12. Moreover, it should be noted that while the illustrated embodiment includes three sensors 102, fewer or more than three sensors 102 may be included in other embodiments. Furthermore, the sensors 102 may be positioned throughout the HVAC system 100 in a different manner than illustrated.

The processor 86, which may be one or more processors, may alter operation of the HVAC unit 12 based on user input as well as data received from sensors 102 present in the HVAC system 100. For instance, as described above, a user may set a desired temperature or range of temperatures of the air within the building 10 via the control devices 16. Based on data from the sensors 102, the control panel 82 may determine whether the conditioned air suppled to the building 10 via the HVAC unit 12 is the desired temperature, within the range of temperatures, or within a threshold of the desired temperature of temperature ranges. Based on such a determination, the control panel 82 may alter operation of the HVAC unit 12. For example, when the air within the building 10 is not the desired temperature, within the desired temperature range, or within a threshold of the desired temperature or temperature range, the control panel 82, via the processor 86, may cause the HVAC unit 12 to operate in a different manner to supply air that will cause the air temperature within the building 10 to correspond to the desired temperature or range of temperatures. In particular, the processor 86 may alter operation of fans of the HVAC unit 12 as well as one or more compressors included in the HVAC unit 12 according to staging operations discussed below.

Figure 6:
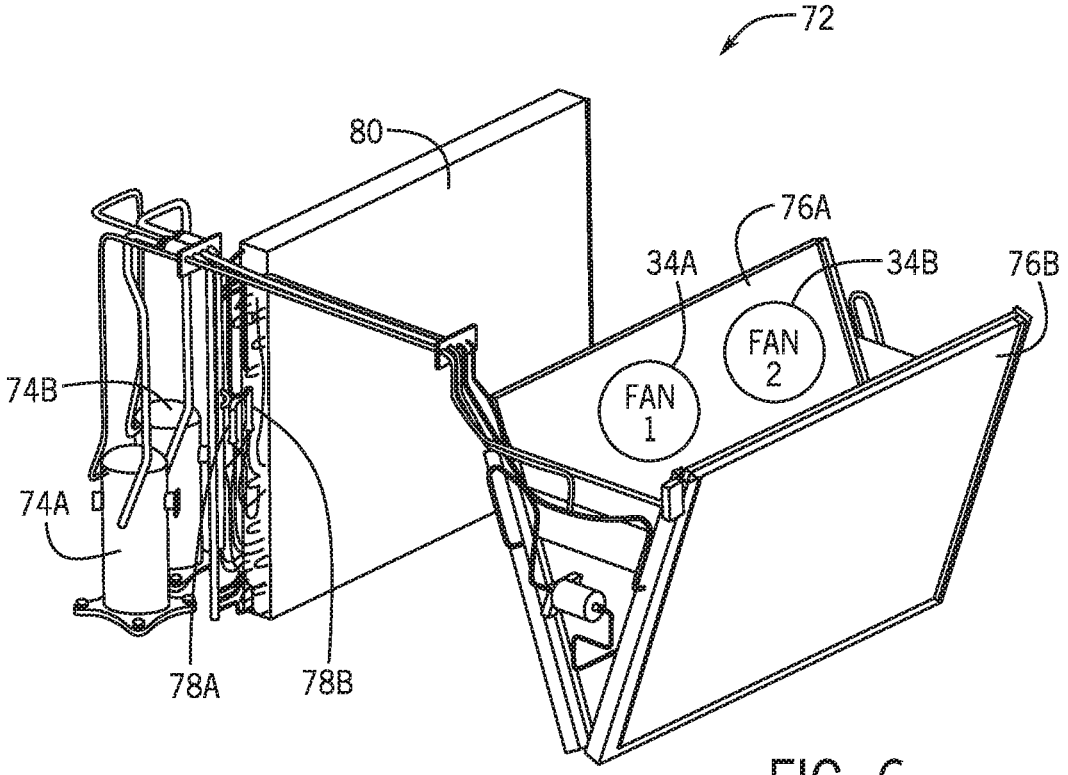
FIG. 6 is a perspective view of a portion of the vapor compression system of FIG. 4, in accordance with embodiments described herein.

Keeping the discussion of FIG. 5 in mind, FIG. 6 is a perspective view of a portion of an embodiment of the vapor compression system 72 that the control panel 82 may control using the compressor and fan staging operations discussed below. The illustrated vapor compression system 72 includes compressors 74, condensers 76, expansion devices 78, and an interlaced evaporator 80. Additionally, the positioning of fans 34 is illustrated. In the illustrated embodiment, the compressors 74 may each supply refrigerant at two different levels of compression settings. That is, the compressors 74 may pump refrigerant though the vapor compression system 72 with two different amounts of refrigerant flow. Additionally, the fans 34 may each be operated at more than one speed. In general, the fans 34 and the components of the vapor compression system 72 operate as described above with reference to FIG. 4, except that the vapor compression system 72 includes two refrigeration circuits. For example, compressor 74A supplies refrigerant to condenser 76A, which directs refrigerant to the expansion device 78A as well as a portion of the evaporator 80. For instance, the interlaced evaporator 80 includes two separate lines through which refrigerant may pass. One of those lines may be fluidly coupled to the compressor 74A, the condenser 76A, and the expansion device 78A to form a first refrigeration circuit. Likewise, the compressor 74B, condenser 76B, and expansion device 78B may be fluidly coupled to another line within the evaporator 80 to form a second refrigeration circuit. Furthermore, each of the compressors 74 may be driven by motors, such a motor 94 of FIG. 4, which may be controlled via a control board included in an HVAC unit, such as control board 82 of HVAC unit 12. In other words, each refrigeration circuit may be controlled by a control board. For example, the components of the refrigeration circuits as well as the fans 34 may be controlled in accordance with the compressors and fan staging described below.

Figure 7:
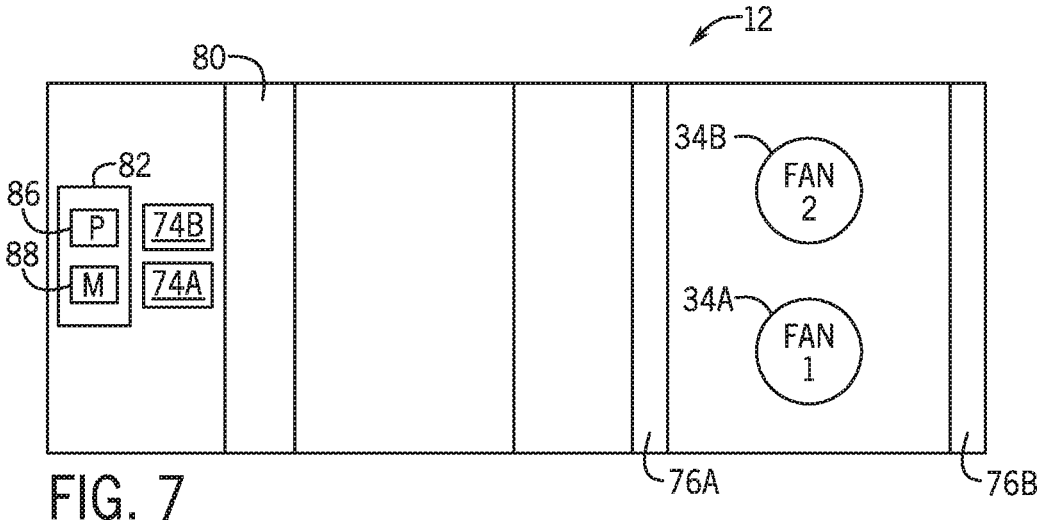
FIG. 7 is a schematic diagram of the HVAC unit of FIG. 1, in accordance with embodiments described herein.
Figure 8:
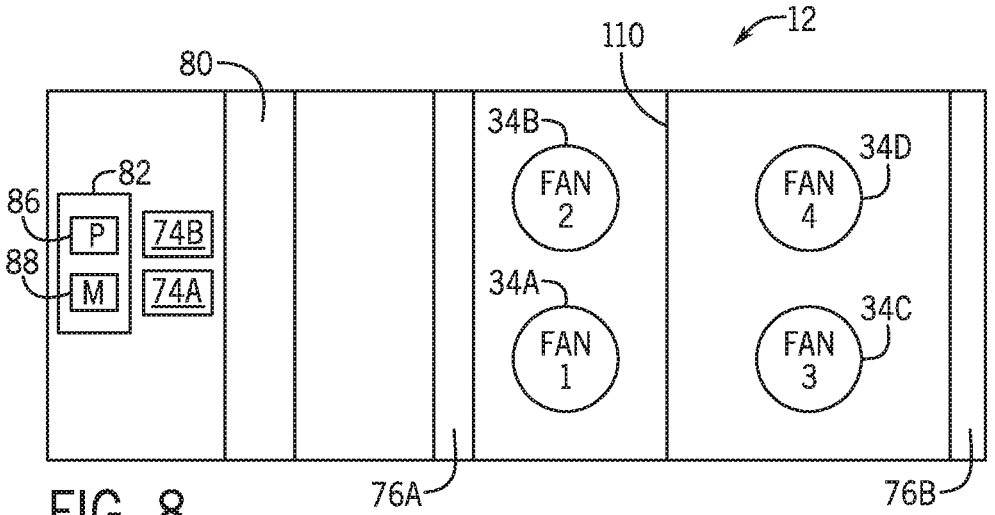
FIG. 8 is a schematic diagram of the HVAC unit of FIG. 1, in accordance with embodiments described herein.
Figure 9:
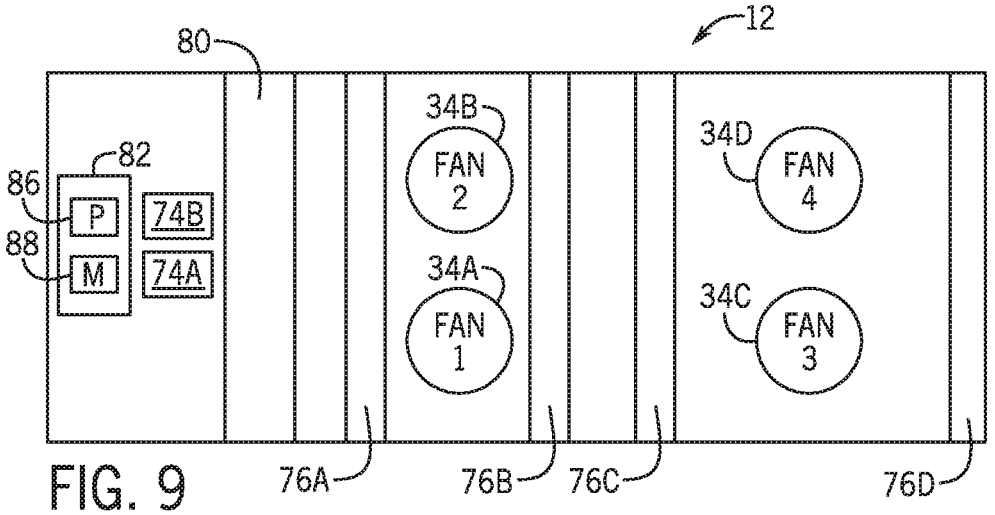
FIG. 9 is a schematic diagram of the HVAC unit of FIG. 1, in accordance with embodiments described herein.

Compressor and fan staging may be used to supply a conditioned space with conditioned air in a manner that is more efficient than in HVAC units that do not implement compressor and fan staging operations described herein. FIGS. 7-9 are schematic diagrams of several embodiments of the HVAC unit 12 that may implement compressor and fan staging in accordance with the present disclosure. Before discussing each of the embodiments separately, it should be noted that each embodiment of the HVAC unit 12 illustrated in FIGS. 7-9 includes at least two fans 34 that may each be set to two or more speeds. Additionally, each embodiment of the HVAC unit 12 includes two compressors 74 that may each circulate refrigerant at two or more levels of compression. In other words, rather than either being on or off, each of the fans 34 and compressors 74 may operate at different settings while activated.

The embodiment of the HVAC unit 12 illustrated in FIG. 7 is a schematic diagram of an HVAC unit that includes the vapor compression system 74 illustrated in FIG. 6. In general, when the processor 86 of the control panel 82 determines that conditioned air should be supplied to a conditioned space, the processor 82 may send signals to cause the compressors 74 and fans 34 of the HVAC unit 12 to operate in accordance with one of the stages described below in Table 1.

TABLE 1

| | Compressor 74A | Compressor 74B | Outdoor Fan 34A | Outdoor Fan 34B |
|---|---|---|---|---|
| First Stage | Low | Off | Low | Low |
| Second Stage | Low | Low | Medium | Medium |
| Third Stage | High | High | High | High |

In the first stage, one of the compressors 74, such as compressor 74A, may be operated to provide refrigerant at first level of compression, such as a low level of compression that is relatively lower than a second level of compression of compressor 74A. For example, compression of the refrigerant provided by the compressor 74A in the first stage may be approximately two-thirds of the compression that the compressor 74A is configured to provide when operating at a maximum compression setting, where "approximately two-thirds" may correspond to 60-75%. The compressor 74B is not activated when operating at the first stage. Additionally, the fans 34A and 34B are operated at a first stage speed setting, such as a low speed setting. This first stage speed setting is lower than two other fan speed settings that are used in the second and third stages.

During a second stage, both compressors 74A and 74B are operated at the first level of compression, such as the low stage or low speed, and the fans 34A and 34B are operated at a second speed, such as a medium speed, that is faster than the low speed of the first stage, but slower than a speed setting associated with the third stage. During the third stage, both compressors 74A and 74B operate to circulate refrigerant at a second, higher level of compression, or high setting. That is, the second level of compression corresponds to the refrigerant being more compressed than in the first two stages, where the compressors 74 are either off or operating on low stage or low speed. For instance, the second level of compression may correspond to both the compressors 74 operating to compress refrigerant at a maximum level of compression. Additionally, the fans 34A and 34B are operated at a speed setting that is faster than the speeds associated with the first and second stages, such as a high speed setting.

It should be noted that more than three stages may be implemented. For instance, in another embodiment, the HVAC unit 12 may operate in accordance with the stages described below in Table 2.

TABLE 2

| | Compressor 74A | Compressor 74B | Outdoor Fan 34A | Outdoor Fan 34B |
|---|---|---|---|---|
| First Stage | Low | Off | Low | Low |
| Second Stage | Low | Low | Medium | Medium |
| Third Stage | High | Low | High | Medium |
| Fourth Stage | High | High | High | High |

As will be appreciated from a comparison of Table 1 to Table 2, the first and second stages from Table 2 are the same as those of Table 1. Additionally, the fourth stage of Table 2 corresponds to the third stage of Table 1. During the third stage of Table 2, one of the compressors 74, such as compressor 74A, provides refrigerant at the second, higher level of compression, such as a high speed or high stage setting, and the other compressor 74B provides refrigerant at the first level of compression, such as the low speed or low stage setting. The second level of compression may be a maximum level of compression that can be provided by the compressor 74. Also, in the third stage, one of the fans 34 is operated at the third, fast speed, and the other fan 34 is operated at the second speed, which may be a medium speed.

It should be noted that more than three or four stages may be implemented. For instance, in another embodiment, the compressors 74 may operate in accordance with the second stage of Table 2, and the fans 34 may operate at different speeds. For example, one of the fans 34 may be operated at a medium speed, and the other fan 34 may be operated at either the first or low speed or the third or high speed.

Turning now to FIG. 8, which is a schematic diagram of an embodiment of the HVAC unit 12 that includes two compressors 74, two condensers 76, and four fans 34 that may be arranged in a manner similar to the arrangement shown in FIG. 6. That is, the condensers 76 may be arranged in the "V" configuration shown in FIG. 6, and the four fans 34 may be positioned between the condensers 76. Additionally, the HVAC unit 12 may include a partition 110 that physically separates air flow paths across the condensers 76.

In such embodiments, fans 34A and 34B may be used to provide environmental air to the condenser 76A, and fans 34C and 34D may provide environmental air to the condenser 76B. As discussed below, the staging operations used for the embodiment of the HVAC unit 12 of FIG. 8 may be the same as the staging used for the embodiment of the HVAC unit 12 illustrated in FIG. 9. As such, the embodiment in FIG. 9 will be discussed before describing the compressor and fan staging that may be used with the embodiment of the HVAC unit 12 of FIG. 8.

FIG. 9 depicts another embodiment of the HVAC unit 12. Similar to the embodiment depicted in FIG. 8, the HVAC unit 12 of FIG. 9 includes two compressors 74 and four fans 34. However, the HVAC unit 12 includes four condensers 76 that may be arranged in a "W" configuration. The condensers 76A and 76B may be fluidly coupled to and in a refrigerant circuit with the compressor 74A, and the condensers 76C and 76D may be fluidly coupled to and in a refrigerant circuit with the compressor 74B. Moreover, the fans 34A and 34B may provide environmental air to the condensers 76A and 76B, while the fans 34C and 34D may provide environmental air to the condensers 76C and 76D. The processor 86 of the control panel 82 may cause the compressors and fans to operate in accordance with the staging described below in Table 3.

TABLE 3

| | Compressor 74A | Compressor 74B | Outdoor Fan 34A | Outdoor Fan 34B | Outdoor Fan 34C | Outdoor Fan 34D |
|---|---|---|---|---|---|---|
| First Stage | Low | Off | Low | Low | Off | Off |
| Second Stage | Low | Low | Low | Low | Low | Low |
| Third Stage | High | High | High | High | High | High |

During the first stage, one of the compressors 74, such as compressor 74A, may provide refrigerant compressed to the first level, such as a low level, of compression to the condensers 76A and 76B. Additionally, the fans 34A and 34B, which provide environmental air to the condenser 76A, operate at a first speed, such as a low speed. Thus, the first refrigerant circuit is in operation in the first stage. The compressor 74B and fans 34C and 34D, which are part of the second refrigerant circuit, are not active during the first stage. During the second stage, the compressors 74A and 74B provide refrigerant at the first level of compression, such as the low level. Additionally, all of the fans 34 operate at the first speed or low speed.

When operating in the third stage, the compressors 74 circulate refrigerant at a second level of compression, such as a high level, and the fans 34 are operated at a second speed, such as a high speed. The second speed may be approximately equal to the third speed described above in the discussion of Tables 1 and 2. For example, the second speed or high speed may be a maximum rated speed of the fans 34.

Similar to the embodiment of the HVAC unit 12 of FIG. 7, the HVAC units illustrated in FIG. 8 and FIG. 9 may be operated according to a sequence of operations that includes more than three levels of staging. For instance, in other embodiments, the HVAC unit 12 may operate in accordance with the stages described below in Table 4.

TABLE 4

| | Compressor 74A | Compressor 74B | Outdoor Fan 34A | Outdoor Fan 34B | Outdoor Fan 34C | Outdoor Fan 34D |
|---|---|---|---|---|---|---|
| First Stage | Low | Off | Low | Low | Off | Off |
| Second Stage | Low | Low | Low | Low | Low | Low |
| Third Stage | High | Low | High | High | Low | Low |
| Fourth Stage | High | High | High | High | High | High |

The first and second stages of Table 4 are the same as those of Table 3. Additionally, the fourth stage of Table 4 corresponds to the third stage of Table 3. During the third or intermediate stage of Table 4, one of the compressors 74, such as compressor 74A, provides refrigerant at the second, high level of compression, and the other compressor 74B provides refrigerant at the first level of compression, such as the low level. Also, the fans 34A and 34B operate at the second speed, such as the high speed, while the fans 34C and 34D operate at the first speed, which is the low speed.

It should be noted that more than three or four stages may be implemented, and more than two fan speeds may be employed. For instance, in another embodiment, the compressors 74 and fans 34 may operate according to another stage in which the compressors 74A and 74B operate at the first level of compression, and two or more of the fans 34 operate at a third speed, such as a medium speed, that is faster than the first speed but slower than the second speed. For instance, the third speed may correspond to the second speed discussed above with reference to Tables 1 and 2.

Figure 10:
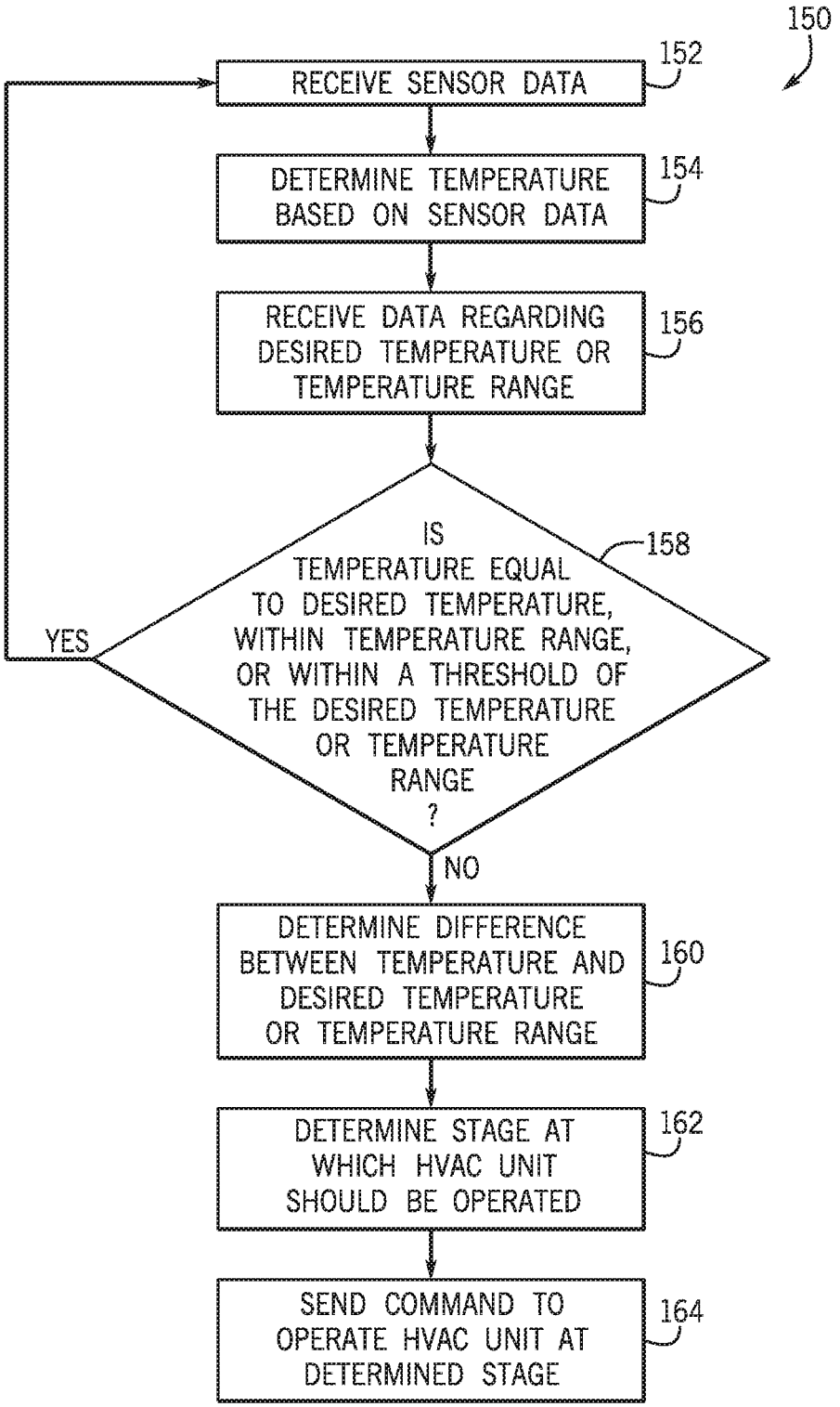
FIG. 10 is a flow chart of a method for controlling the HVAC system of FIG. 1, in accordance with embodiments described herein.

The control board 82 may control operation of the components of the HVAC unit 12 in accordance with an embodiment of the staging described above based on data received from the control devices 16 and sensors 102. FIG. 10 is a flow chart of a method 150 for controlling operation of the HVAC unit 12 in accordance with the techniques described above. The method 150 may be performed by the processor 86 of the control board 82. Additionally, the method 150 may also be performed by another suitable processor, such as a processor that may be included in one of the control devices 16. In other words, while the method 150 is described below as being performed by the processor 86 of the control board 82, in other embodiments, one or more of the control devices 16 may also perform the method 150.

At block 152, the processor 86 may receive sensor data from the sensors 102 regarding air in the HVAC unit 12 and/or a conditioned space, such as the building 10. For instance, the sensor data is indicative of air temperature, and may also be indicative of other characteristics of the air, such as pressure or humidity. At block 154, the processor 86 may determine an air temperature based on the sensor data.

At block 156, the processor 86 may receive data regarding a desired temperature or temperature range. For example, a user may input the desired temperature or a desired range of temperature values via the control device 16. As described above, the control device 16 is communicatively coupled to the processor 86. Hence, the processor 86 may receive the data regarding the desired temperature or temperature range from the control device 16.

At block 158, the processor 86 may determine whether the temperature determined at block 154 is equal to the desired temperature, within the desired temperature range, or within a threshold amount of the desired temperature or desired temperature range. When the processor 86 determines that the temperature is equal to the desired temperature, within the desired temperature range, or within a threshold amount of the desired temperature or desired temperature range, the processor 86 may continue to collect sensor data, as indicated by block 152.

However, if at block 158, the processor 86 determines that the temperature indicated by the sensor data is not equal to the desired temperature, within the desired temperature range, or within a threshold amount of the desired temperature or desired temperature range, at block 160, the processor 86 may determine a difference between the temperature and the desired temperature or the temperature range. More specifically, the temperature difference may be the difference between the temperature determined at block 154 and one of the temperature values associated with the temperature range, such as a minimum or maximum temperature of the temperature range.

At block 162, the processor 86 may determine a stage at which the HVAC unit 12 should be operated. For example, the stage may be any of the stages described above. More specifically, the temperature difference determined at block 158 may correspond to a particular stage. For instance, the memory 88 of the control board 82 may include one or more look-up tables that relate temperature differences to the various stages that may be employed by the HVAC unit 12. The processor 86 may access the look-up table to determine at which stage the HVAC unit 12 should be operated.

At block 164, the processor 86 may send a command for the HVAC unit 12 to operate at the stage determined at block 162. For instance, the processor 86 may send a command for the fans 34 to operate at one or more speeds according to the determined stage as well as for one or more of the compressors 74 to operate at one or more of the compression levels discussed above.

The method 150 may repeated any suitable number of times. For example, as a result of a first iteration of the method 150, one stage may be implemented in the HVAC unit 12. However, at another time, such as a time when the temperature difference determined between the measured temperature and the desired temperature or temperature range is different, another iteration of the method 150 may result in another, different stage being implemented.

While the selection of a stage at which the HVAC unit 12 should be operated is described as being based on the temperature difference determined at block 160, in other embodiments, the determination of the stage may be made based on other factors. For example in addition to the difference between the measured temperature and the desired temperature or temperature range, the temperature of environmental air that may be conditioned by the HVAC unit 12 and supplied to the conditioned space may be also be considered. For example, one or more sensors 102 may collect data regarding environmental air, the processor 86 may determine the temperature of the environmental air based on the sensor data, and the memory 88 may include a look-up table that describes temperature differences, environmental air temperatures, and the stages associated with a particular combination of a temperature difference and an environmental air temperature. The processor 86 may then determine which stage the HVAC unit 12 should operate at by accessing the look-up table and send a command for the HVAC unit 12 to operate at the determined stage. Additional or alternative parameters that may be considered in determining which stage to implement include pressure, humidity, occupancy of the conditioned space, electricity costs, and the refrigerant temperatures and pressures in the HVAC unit 12, among other factors.

While only certain features and embodiments of the present disclosure have been illustrated and described, many modifications and changes may occur to those skilled in the art without materially departing from the novel teachings and advantages of the subject matter recited in the claims. For instance, the modifications and changes may include variations in sizes, dimensions, structures, shapes and proportions of the various elements, values of parameters such as temperatures or pressures, mounting arrangements, use of materials, colors, orientations, and the like. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) unit, comprising:

a first refrigeration circuit comprising a first compressor and a first condenser;

a second refrigeration circuit comprising a second compressor and a second condenser;

a first fan configured to generate airflow over the first condenser;

a second fan configured to generate airflow over the second condenser;

an evaporator common to the first refrigeration circuit and the second refrigeration circuit; and a controller configured to control operation of the HVAC unit according to an active staging operation of a plurality of staging operations, wherein the plurality of staging operations comprises at least three stages of operation in which each of the first and second compressors individually operates in a selection of at least two compression settings and each of the first and second fans individually operates in a selection of at least two speed settings.

2. The HVAC unit of claim 1, wherein the controller is configured to control operation of the HVAC unit according to the active staging operation of the plurality of staging operations, the plurality of staging operations comprising:

a first stage operation of the first compressor at a first compression setting, the first fan at a first speed setting, the second compressor turned off, and the second fan at the first speed setting;

a second stage operation of the first compressor at the first compression setting, the first fan at a second speed setting, the second compressor at the first compression setting, and the second fan at the second speed setting; and a third stage operation of the first compressor at a second compression setting, the first fan at a third speed setting, the second compressor at the second compression setting, and the second fan at the third speed setting.

3. The HVAC unit of claim 2, wherein the first compression setting is a low compression setting, and the first speed setting is a low speed setting.

4. The HVAC unit of claim 2, wherein the second speed setting is greater than the first speed setting.

5. The HVAC unit of claim 4, wherein the second compression setting is greater than the first compression setting, and wherein the third speed setting is greater than the second speed setting.

6. The HVAC unit of claim 5, wherein the plurality of staging operations comprises a fourth staging operation of the first compressor at the second compression setting, the first fan at the third speed setting, the second compressor at the first compression setting, and the second fan at the second speed setting.

7. The HVAC unit of claim 1, wherein the first fan is configured to generate airflow over the first and second condenser, and the second fan is configured to generate airflow over the first and second condenser.

8. The HVAC unit of claim 1, wherein the first condenser and the second condenser are separated by a partition.

9. The HVAC unit of claim 1, wherein the controller is configured to select the active staging operation of the plurality of staging operations based on feedback from a sensor of the HVAC unit.

10. The HVAC unit of claim 9, wherein the sensor is configured to detect a temperature of air within a conditioned space that receives conditioned air from the HVAC unit.

11. The HVAC unit of claim 1, comprising a third fan configured to generate airflow over the first condenser and a fourth fan configured to generate airflow over the second condenser.

12. The HVAC unit of claim 11, wherein the controller is configured to control operation of the HVAC unit according to the active staging operation of the plurality of staging operations comprising:

a first stage operation of the first compressor at a first compression setting, the first fan at a first speed setting, the second compressor turned off, the second fan at the first speed setting, the third fan turned off, and the fourth fan turned off;

a second stage operation of the first compressor at the first compression setting, the first fan at the first speed setting, the second compressor at the first compression setting, the second fan at the first speed setting, the third fan at the first speed setting, and the fourth fan at the first speed setting; and a third stage operation of the first compressor at a second compression setting, the first fan at a second speed setting, the second compressor at the second compression setting, the second fan at the second speed setting, the third fan at the second speed setting, and the fourth fan at the second speed setting.

13. The HVAC unit of claim 12, wherein the first fan, the second fan, the third fan, and the fourth fan each only have two fan speed settings.

14. The HVAC unit of claim 12, wherein the plurality of staging operations comprises a fourth staging operation of the first compressor at the second compression setting, the first fan at the second speed setting, the second compressor at the first compression setting, the second fan at the second speed setting, the third fan at the first speed setting, and the fourth fan at the first speed setting.

15. The HVAC unit of claim 11, wherein the first fan and the third fan are configured to generate airflow over a third condenser of the first refrigeration circuit, and wherein the second fan and the fourth fan are configured to generate airflow over a fourth condenser of the second refrigeration circuit.

16. A heating, ventilation, and air conditioning (HVAC) system, comprising:

a plurality of compressors, wherein each compressor of the plurality of compressors comprises multiple compression settings;

a plurality of fans, wherein each fan of the plurality of fans comprises multiple speed settings;

an interlaced evaporator, wherein each compressor of the plurality of compressors is configured to circulate refrigerant through the interlaced evaporator; and a controller configured to control operation of each fan of the plurality of fans and each compressor of the plurality of compressors according to an active staging operation of a plurality of staging operations, wherein each staging operation of the plurality of staging operations comprises instructions to operate each compressor of the plurality of compressors individually in a selection of at least two compression settings and each fan of the plurality of fans individually in a selection of at least two speed settings.

17. The HVAC system of claim 16, wherein the plurality of compressors comprises a first compressor and a second compressor, the plurality of fans comprises a first outdoor fan and a second outdoor fan, and, in a first staging operation of the plurality of staging operations, the controller is configured to:

operate the first compressor at a first compression setting;

not operate the second compressor;

operate the first outdoor fan at a first speed setting; and operate the second outdoor fan at the first speed setting.

18. The HVAC system of claim 16, wherein the plurality of compressors comprises a first compressor and a second compressor, the plurality of fans comprises a first outdoor fan, a second outdoor fan, a third outdoor fan, and a fourth outdoor fan, and, in a first staging operation of the plurality of staging operations, the controller is configured to:

operate the first compressor at a first compression setting;

not operate the second compressor;

operate the first outdoor fan at a first speed setting;

operate the second outdoor fan at the first speed setting;

not operate the third outdoor fan; and not operate the fourth outdoor fan.

19. The HVAC system of claim 18, wherein the first outdoor fan and the second outdoor fan are configured to draw environmental air over a first condenser in a first refrigerant circuit with the first compressor, and the third outdoor fan and the fourth outdoor fan are configured to draw environmental air over a second condenser in a second refrigerant circuit with the second compressor.

20. The HVAC system of claim 18, wherein, in a second staging operation of the plurality of staging operations, the controller is configured to:

operate the first compressor at the first compression setting;

operate the second compressor at the first compression setting;

operate the first outdoor fan at the first speed setting;

operate the second outdoor fan at the first speed setting;

operate the third outdoor fan at the first speed setting; and operate the fourth outdoor fan at the first speed setting.

21. The HVAC system of claim 20, wherein, in a third staging operation of the plurality of staging operations, the controller is configured to:

operate the first compressor at a second compression setting greater than the first compression setting;

operate the second compressor at the second compression setting;

operate the first outdoor fan at a second speed setting greater than the first speed setting;

operate the second outdoor fan at the second speed setting;

operate the third outdoor fan at the second speed setting; and operate the fourth outdoor fan at the second speed setting.

22. The HVAC system of claim 21, wherein, in a fourth staging operation of the plurality of staging operations, the controller is configured to:

operate the first compressor at the second compression;

operate the second compressor at the first compression setting;

operate the first outdoor fan at the second speed setting;

operate the second outdoor fan at the second speed setting;

operate the third outdoor fan at the first speed setting; and operate the fourth outdoor fan at the first speed setting.

23. A heating, ventilation, and air conditioning (HVAC) unit, comprising:

a first refrigeration loop comprising a first compressor;

a second refrigeration loop comprising a second compressor;

a first outdoor fan and a second outdoor fan associated with the first refrigeration loop;

a third outdoor fan and a fourth outdoor fan associated with the second refrigeration loop;

an interlaced evaporator common to the first refrigeration loop and the second refrigeration loop; and a controller configured to control operation of the first outdoor fan, the second outdoor fan, the third outdoor fan, the fourth outdoor fan, the first compressor, and the second compressor according to each staging operation of a plurality of staging operations, wherein the first outdoor fan, the second outdoor fan, the third outdoor fan, and the fourth outdoor fan each comprise multiple speed settings, and the first compressor and the second compressor each comprise multiple compression settings.

24. The HVAC unit of claim 23, wherein the first refrigeration loop comprises a first condenser, and the first outdoor fan and the second outdoor fan are configured to draw environmental air over the first condenser, and the second refrigeration loop comprises a second condenser, and the third outdoor fan and the fourth outdoor fan are configured to draw environmental air over the second condenser.

25. The HVAC unit of claim 23, wherein the first refrigeration loop comprises a first condenser and a second condenser, the first outdoor fan and the second outdoor fan are configured to draw environmental air over the first condenser and the second condenser, the second refrigeration loop comprises a third condenser and a fourth condenser, and the third outdoor fan and the fourth outdoor fan are configured to draw environmental air over the third condenser and the fourth condenser.

26. The HVAC unit of claim 23, wherein, in a first staging operation of the plurality of staging operations, the controller is configured to:

operate the first compressor at a first compression setting;

not operate the second compressor;

operate the first outdoor fan at a first speed setting;

operate the second outdoor fan at the first speed setting;

not operate the third outdoor fan; and not operate the fourth outdoor fan.

27. The HVAC unit of claim 26, wherein in a second staging operation of the plurality of staging operations, the controller is configured to:

operate the first compressor at the first compression setting;

operate the second compressor at the first compression setting;

operate the first outdoor fan at the first speed setting;

operate the second outdoor fan at the first speed setting;

operate the third outdoor fan at the first speed setting; and operate the fourth outdoor fan at the first speed setting.

28. The HVAC unit of claim 27, wherein, in a third staging operation of the plurality of staging operations, the controller is configured to:

operate the first compressor at a second compression setting greater than the first compression setting;

operate the second compressor at the second compression setting;

operate the first outdoor fan at a second speed setting greater than the first speed setting;

operate the second outdoor fan at the second speed setting;

operate the third outdoor fan at the second speed setting; and operate the fourth outdoor fan at the second speed setting.

29. The HVAC unit of claim 28, wherein the controller is configured to select one of the first staging operation, the second staging operation, and the third staging operation based on feedback from a sensor configured to detect a temperature of air within a conditioned space.

* * * * *